US008456303B1

(12) United States Patent
Pienkos

(10) Patent No.: US 8,456,303 B1
(45) **Date of Patent: *Jun. 4, 2013**

(54) SYSTEM AND METHOD FOR ASSOCIATING ITEMS OF A SET

(75) Inventor: John T. Pienkos, Glendale, WI (US)

(73) Assignee: Innovaport LLC, Milwaukee, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/385,883

(22) Filed: Mar. 12, 2012

Related U.S. Application Data

(63) Continuation of application No. 12/157,554, filed on Jun. 11, 2008, now Pat. No. 8,154,403.

(60) Provisional application No. 60/934,092, filed on Jun. 11, 2007.

(51) Int. Cl.
*G08B 1/08* (2006.01)
*G08B 13/14* (2006.01)

(52) U.S. Cl.
USPC ..... 340/539.32; 340/539.11; 340/572.1

(58) Field of Classification Search
USPC ..... 340/539.1, 539.11, 539.13, 539.32, 340/568.1, 568.6, 571, 572.1, 572.4, 825.49, 340/10.1; 455/404.1, 404.2, 414.2, 456.3, 455/561, 562.1; 446/175, 297
See application file for complete search history.

(56) References Cited

U.S. PATENT DOCUMENTS 5,546,955 A 8/1996 Wilk
6,297,737 B1 10/2001 Irvin
6,335,686 B1 * 1/2002 Goff et al. ..... 340/572.4
6,700,533 B1 3/2004 Werb et al.
6,788,200 B1 9/2004 Jamel et al.
7,034,684 B2 * 4/2006 Boman et al. ..... 340/568.1
7,205,894 B1 4/2007 Savage
7,228,649 B2 6/2007 Elliott
7,299,034 B2 11/2007 Kates
7,568,963 B1 * 8/2009 Atsmon et al. ..... 446/175
7,914,392 B2 3/2011 Elliott
8,014,763 B2 * 9/2011 Hymes ..... 455/414.2
2002/0192829 A1 12/2002 Zainiev et al.
2003/0067397 A1 * 4/2003 Trimble ..... 340/825.49
2003/0214408 A1 11/2003 Grajales et al.

(Continued)

OTHER PUBLICATIONS

"Switch Types", obtained at http://www.allaboutcircuits.com/vol_4/chpt-4/1.html, 6 pages, printed on Mar. 30, 2006 (admitted prior art).

(Continued)

*Primary Examiner* — Van T. Trieu

(57) ABSTRACT

A system provides for facilitating the location of a first item of a set of items, as well as a wireless communication device and a related method of operation. In at least some embodiments, the system includes a first wireless device associated with the first item of the set, the first wireless device including an output device and a receiver, and a second wireless device associated with a second item of the set, the second wireless device including an input device and a transmitter. The second wireless device in response to an input signal transmits a wireless signal to the first wireless device, which in response provides a first output signal that is either sufficiently visible or sufficiently audible so as to facilitate the location of the first item of the set. In some embodiments, the wireless devices are aftermarket devices capable of being attached to the items.

20 Claims, 5 Drawing Sheets

U.S. PATENT DOCUMENTS

| | | | | |
|---|---|---|---|---|
| 2004/0252030 | A1* | 12/2004 | Trimble et al. | 340/825.36 |
| 2005/0198029 | A1 | 9/2005 | Pohja et al. | |
| 2007/0150091 | A1 | 6/2007 | Griffits | |
| 2008/0079902 | A1 | 4/2008 | Mandelstam-manor et al. | |
| 2012/0064855 | A1* | 3/2012 | Mendelson | 455/404.2 |

OTHER PUBLICATIONS

"Membrane Switches", obtained at http://www.melrose-nl.com/membraneswitch.html?source=googleadwords, 2 pages, printed on Mar. 30, 2006 (admitted prior art).

* cited by examiner

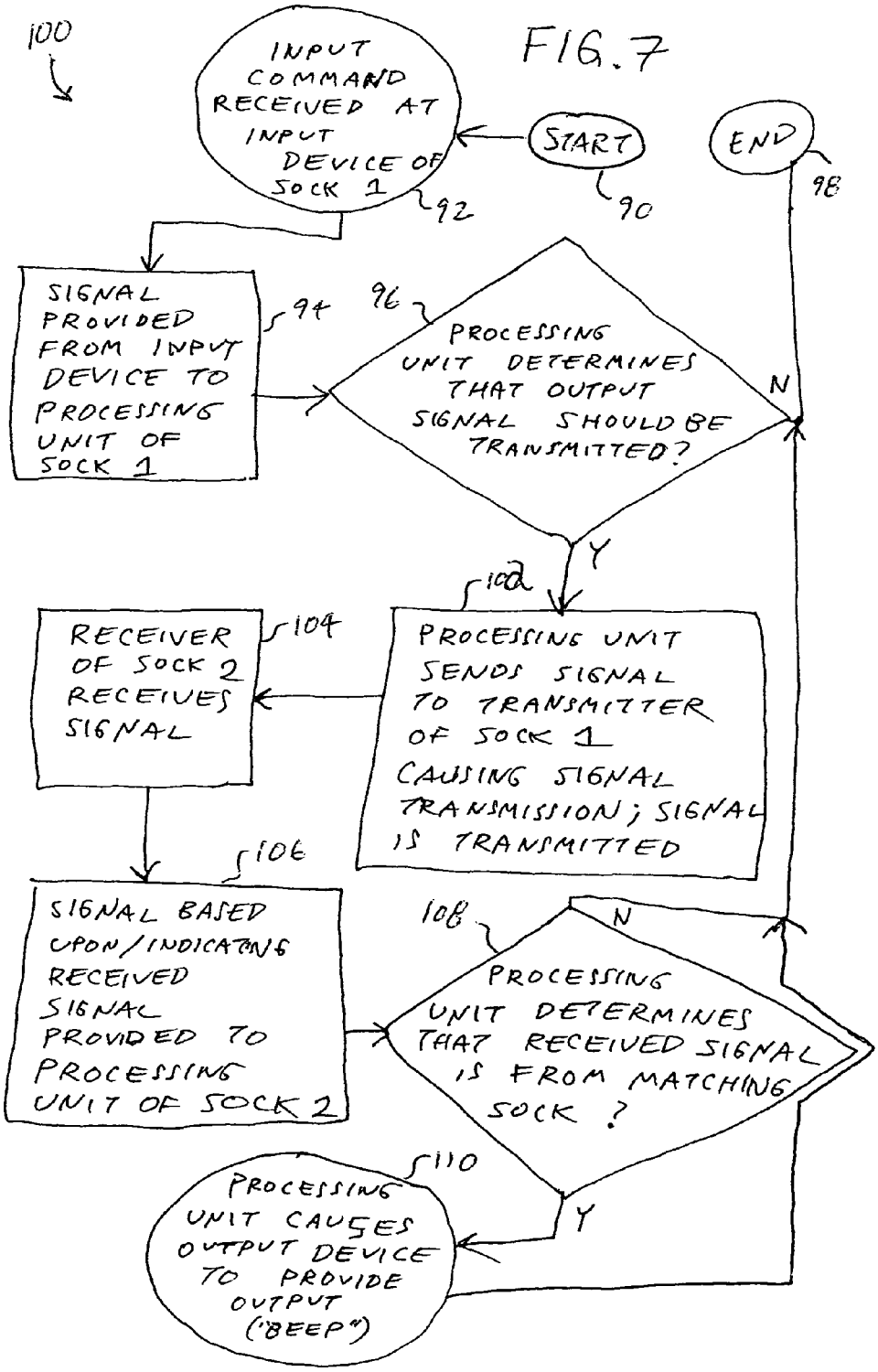
100
FIG. 7
START
90
INPUT COMMAND RECEIVED AT INPUT DEVICE OF SOCK 1
92
END
98
SIGNAL PROVIDED FROM INPUT DEVICE TO PROCESSING UNIT OF SOCK 1
94
96
PROCESSING UNIT DETERMINES THAT OUTPUT SIGNAL SHOULD BE TRANSMITTED?
N
Y
102
PROCESSING UNIT SENDS SIGNAL TO TRANSMITTER OF SOCK 1 CAUSING SIGNAL TRANSMISSION; SIGNAL IS TRANSMITTED
104
RECEIVER OF SOCK 2 RECEIVES SIGNAL
106
SIGNAL BASED UPON/INDICATING RECEIVED SIGNAL PROVIDED TO PROCESSING UNIT OF SOCK 2
108
PROCESSING UNIT DETERMINES THAT RECEIVED SIGNAL IS FROM MATCHING SOCK ?
N
Y
110
PROCESSING UNIT CAUSES OUTPUT DEVICE TO PROVIDE OUTPUT ("BEEP")

SYSTEM AND METHOD FOR ASSOCIATING ITEMS OF A SET

CROSS-REFERENCE TO RELATED APPLICATIONS

This application is a continuation of U.S. patent application Ser. No. 12/157,554 entitled "SYSTEM AND METHOD FOR ASSOCIATING ITEMS OF A SET" filed on Jun. 11, 2008, now U.S. Pat. No. 8,154,403, which is based upon U.S. Provisional Application No. 60/934,092 filed Jun. 11, 2007 having the same title, claims the benefit of both of these applications, and hereby incorporates by reference herein both patent applications.

FIELD OF THE INVENTION

The present invention relates to wireless communications and, more particularly, relates to systems of devices that are equipped for wireless communications therebetween.

BACKGROUND OF THE INVENTION

There are many types of items in the world that belong to sets of items. For example, many such sets of items are garment items that come in pairs of two to match aspects of human anatomy. Among these are, for example, socks, shoes, mittens and gloves. Many other sets of items also exist. Further for example, sets of china and silverware typically with multiple pieces that belong together. Multiple information-recording media such as DVDs and CDs, videotapes and other tapes, computer disks, or even volumes of books can come together in sets. Likewise, tools often come in sets of items, as can toys, games (e.g., chess boards), and numerous other commonplace items.

Sets of items often include or are solely made up of numerous items of the same or similar type. Yet many other sets of items include or are made up of items that differ from one another in various ways. In some circumstances, the items of the set can be significantly different from one another. For example, in the case of a tool set as mentioned above, the set could include a hammer, a saw, a screwdriver, and a drill, each of which is considerably different from the other items in the set. In other circumstances, the items of the set can be similar albeit complementary with one another. Again for example, a pair of socks will often include a left sock and a right sock that are different from one another and yet complementary. Pants and a coat of a suit likewise can be considered as complementary items. Further for example, a pen and a complementary cap for the pen can be thought of as a set of items that are complementary.

While sets of items of these and other types are often of great value, such sets of items can lose much of their value when one or more of the items of a given set become lost or difficult to locate. The loss or misplacement of an item of a set can, indeed, be of great irritation to the owner or user of a set of items. While sometimes the item of a set becomes disassociated from the other item or items of the set in a way that would irrevocably prevent its reassociation with the set, this is not always the case. In many cases, a lost or difficult-to-locate item of a set is very close to, or relatively proximate to, the other items of the set, notwithstanding the fact that at the present moment it cannot be found by the person looking for it. For example, a tool, toy, game piece, or garment item (e.g., a shoe) of a set of such items often cannot be found even though the missing item is still located, along with the other items of the set, within the house/domicile of an owner or user who is looking for it.

Indeed, in some circumstances a person will know the general location of an item and yet not be able to associate that item with the other item(s) in the set. Further for example, a person can have before them a pile of thirty socks and yet be unable (without significant effort) to match a given sock with its mate within the pile of socks, or even with one of several possible mates within the pile of socks.

For at least these reasons, therefore, it would be advantageous if a new system (and/or apparatus/device) and method could be developed that, in at least some embodiments, facilitated the identification, location, finding, matching, and/or other association of items of a set.

SUMMARY OF THE INVENTION

The present inventor has recognized that it would be possible in many circumstances to equip some or all of the items in a given set of items with wireless transmitter(s) and/or receiver(s) that would allow wireless communications between or among some or all of the items of a given set (and possibly with other items outside the set as well). In at least some embodiments, a wireless transmission generated at one item of a set would, upon receipt by the receiver(s) of other item(s) of the set, trigger an output or outputs to occur at the receiving item(s). Assuming then that the item generating the transmission was in the immediate possession of a user/owner of the set of items, and assuming that an appropriate output or outputs (for example, a sound or light) was/were provided, the user/owner could then identify, locate, find, match or otherwise associate a misplaced item or misplaced items with the item in the user/owner's possession upon sensing the output or outputs subsequent to causing the transmission to occur.

In at least some embodiments, the present invention relates to a system for facilitating the location of a first item of a set of items. The system includes a first wireless communication device associated with the first item of the set, the first wireless communication device including an output device and a first wireless receiver. The system further includes a second wireless communication device associated with a second item of the set, the second wireless communication device including an input device and a first wireless transmitter. The second wireless communication device in response to a first input signal provided via the input device transmits a first wireless signal by way of the first wireless transmitter, and the first wireless communication device receives the first wireless signal and provides a first output signal in response to receiving the first wireless signal. Additionally, the first output signal is at least one of sufficiently visible and sufficiently audible so as to facilitate the location of the first item of the set, and the first and second items during an absence of the first and second wireless communication devices would be unable to communicate a wireless signal therebetween from the second item to the first item.

Further, in at least some embodiments, the present invention relates to a modular, after-market wireless communication device suitable for attachment to a non-wireless structure, which includes a processing unit, at least one of a wireless transmitter and a wireless receiver coupled to the processing unit, at least one of an input device and an output device coupled to the processing unit, and means for attaching the wireless communication device to the structure. The wireless communication device is configured to allow for limited communication with at least one additional wireless communication device in which a wireless signal is transmitted by one of the devices upon receipt of an input command and in which the other device outputs an output signal via the output device upon receiving the wireless signal, the output signal being configured to facilitate a locating of the structure by a person searching for the structure.

Additionally, in at least some embodiments, the present invention relates to a method of locating a first item of a set of items. The method includes providing an input command to a first wireless communication device associated with a second item of the set, and transmitting a first wireless signal from the first wireless communication device to a second wireless communication device associated with the first item of the set. The method further includes outputting at least one of an audible signal and a visible signal, whereby a person searching for the first item is able to sense the audible or visible signal and thereby locate the first item of the set.

BRIEF DESCRIPTION OF THE DRAWINGS

FIG. 7 is a flow chart illustrating exemplary steps of operation of the items of FIG. 2 employing wireless communications devices having internal parts such as those of FIG. 5 in order to achieve an exemplary manner of association of the items.

DETAILED DESCRIPTION OF THE DRAWINGS

Figure 1:
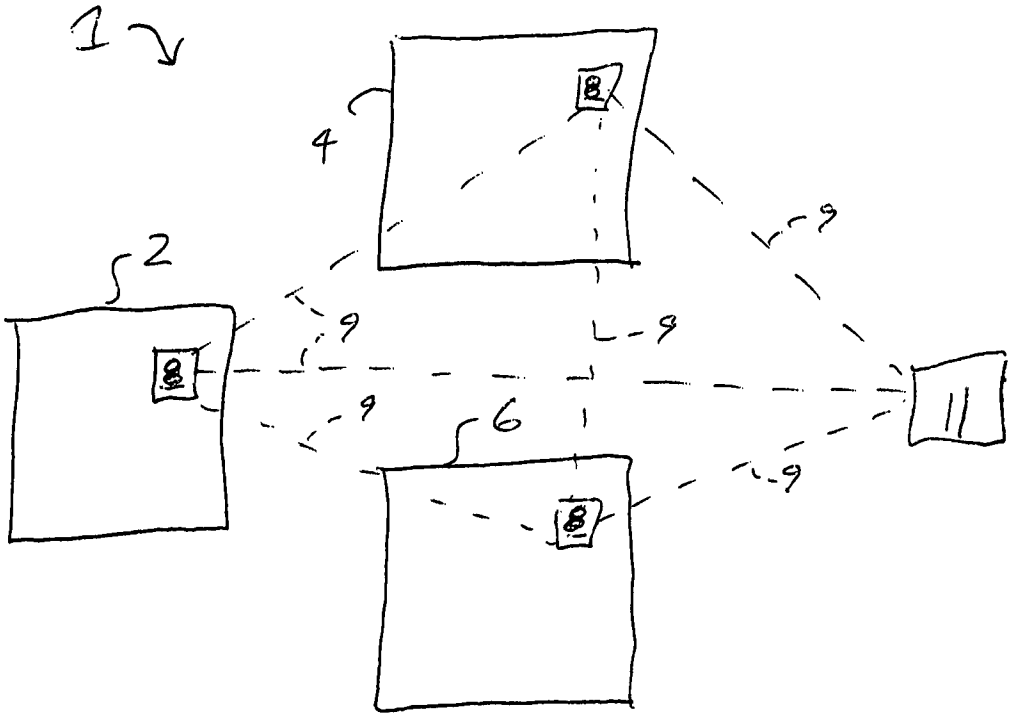
FIG. 1 is a block diagram showing in schematic form an exemplary plurality of items of a set that are in communication with one another by way of wireless devices in accordance with at least some embodiments of the present invention.

Referring to FIG. 1, one embodiment of the present invention is shown in exemplary form to include a first set of related items 1 having first, second and third items 2, 4 and 6. The set of related items 1 is intended to be representative of any set of items that are related in terms of their functional purpose, in terms of the manner in which they are sold (e.g., the items are intended to be sold as a set), in terms of their appearance, or in terms of some other aspect such that one or more persons view the items of the set to be related in some manner to one another.

As will be described in further detail with reference to FIGS. 2 and 3, for example, the set of related items 1 can be a set of clothing or garment items, or a set of tools. Further for example, the set of related items 1 can be any of a variety of other sets of things including, further for example, a set of toys, a set of games or game pieces, a set of dishware and/or glassware, a set of books or other reading materials, a set of musical instruments, a set of utensils such as silverware, a set of pieces of electrical equipment or components (e.g., speakers), a set of luggage items, a set of pieces of other types of equipment such as gardening equipment, a set of information recoding media (e.g., a set of CD-ROMs or DVDs), a set of containers of fluids that go together as a set (e.g., multiple bottles of various cleansers), etc.

Figure 2:
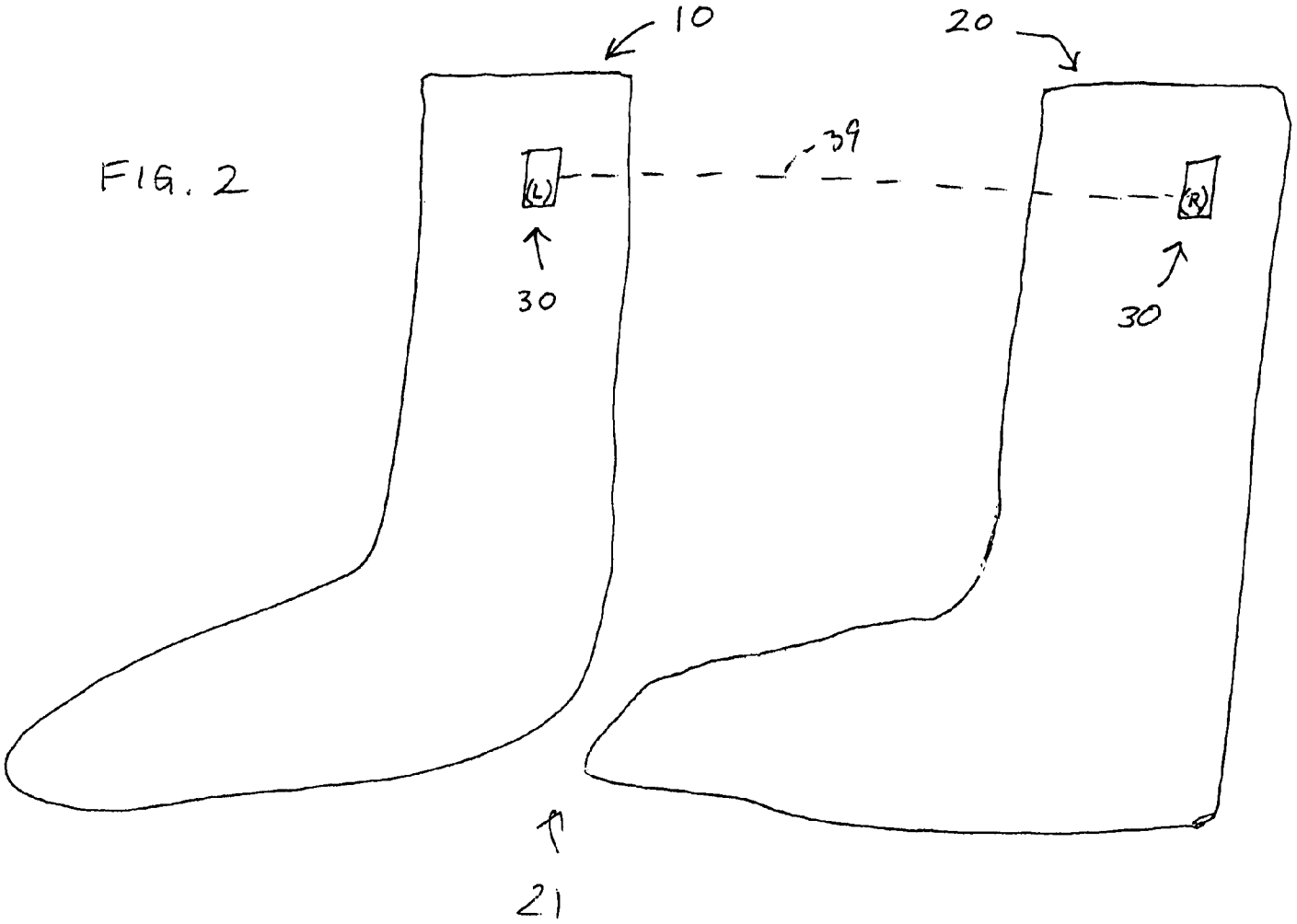
FIG. 2 is one embodiment of an exemplary set of items that are in wireless communications with one another, in accordance with one embodiment of the present invention.

While in many circumstances, the set of items will include items that are identical or similar to one another (for example, as indicated in FIG. 2, left and right socks; or two pieces of luggage from a set of luggage), in other circumstances, the set of items will include items that are complementary to one another (for example, a pen and a related pencap; an electronic device and a corresponding power supply or battery; an electronic device such as a computer and a bag for carrying the computer; a container of fluid and a device that user that fluid). Although the set of items 1 of FIG. 1 includes three items 2, 4 and 6, it will be understood that the present invention also can relate to sets of items having two items (e.g., the socks of FIG. 2), as well as more than three items. Thus, the present invention is intended to be applicable to many various types of sets of items, and is not intended to be limited to the particular sets of items described in detail herein.

To allow or facilitate the identification; location, finding, matching, and/or other association of items of a set of related items such as the set of items 1, in accordance with embodiments of the present invention, some or all of the items of the set are equipped with one (or possibly more than one) wireless communication devices, shown in FIG. 1 as devices 8. As will be described in further detail below, the devices 8 are capable of wireless communications with one another by way of one or more wireless communications links or networks 9.

In some embodiments, each of the devices 8 is capable of two-way communications with one or more of the other devices, that is, capable of both transmitting and receiving signals with such other devices. However, in alternate embodiments, one or more of the devices 8 is only capable of one-way communications (e.g., transmitting or receiving signals, but not both). In the present embodiment shown in FIG. 1, all of the devices 8 on items 2, 4 and 6 are capable of communication with one another, albeit in other embodiments only certain selective communications might be possible. For example, the device 8 of the item 2 might only be able to communicate with that of item 4, and the device of item 4 might only be able to communicate with that of item 6.

Additionally as shown in FIG. 1, for generality the wireless communication devices 8 associated with the items 2, 4 and 6 are also capable of communicating with a further wireless communication device 11. The device 11 is not positioned on any item of the set of items 1. The providing of the device 11 is intended to be indicative of the fact that, in at least some embodiments of the present invention, the devices 8 of a set of items can also be in communication with other devices that are not physically mounted on the items of the set.

At the same time, while device 11 is shown in FIG. 1, FIG. 1 is also intended to be representative of embodiments in which multiple such devices such as device 11 are in communication with the devices 8 on the set of items 1, or where no such additional devices such as device 11 are present or utilized. Further, while device 11 is shown to be in communication with the devices 8 by way of the same type of communication links 9 as exist between the devices 8, it will be understood that other types of communication links can also be employed. Additionally, as will be described below, the device 11 typically will be mounted on or otherwise associated with some other device or structure. As a result, in at least some circumstances, it would be appropriate to consider the device or structure with respect to which the device 11 is associated as being part of a set of items that also includes the items 2, 4 and 6 on which the devices 8 are mounted, regardless of whether the underlying device or structure on which the device 11 is mounted is similar in nature or functional purpose to the items 2, 4 and 6.

Turning to FIG. 2, in another exemplary embodiment of the present invention, a set of items 21 includes first and second matching, complementary (e.g., left and right) socks 10 and 20, respectively. Each of the socks 10, 20 has a wireless communications device 30 (corresponding to the devices 8 of FIG. 1) allowing for communications therebetween by way of a communication link 39. Although FIG. 2 shows only 2 socks to be in the set of items 21, it will be understood that in some other cases more than 2 socks would be in communication with one another, for example, 12 socks of a set of 12 socks of the same type that come in a package.

The embodiment of FIG. 2 is intended to be indicative of the fact that the present invention is applicable to a variety of sets of related clothing articles and garments including not merely socks but also, for example, shoes or boots, mittens or gloves, suit coats and related pants, complementary blouses and skirts (and/or sweaters, jackets, dresses, pants or other garments), matching bedsheets and/or pillowcases, related towels, and many other such items. As will be described in more detail with reference to FIG. 7, the present invention is helpful in various circumstances including, for example, facilitating the association of pairs of socks when sorting socks (e.g., trying to find a match for a sock within a pile of dozens of socks). Likewise, in a situation where a left shoe of a pair of shoes was in the possession of a person but a corresponding right shoe of the pair was misplaced somewhere else in the person's home, the present invention would be helpful in facilitating the finding of the right shoe.

Figure 3:
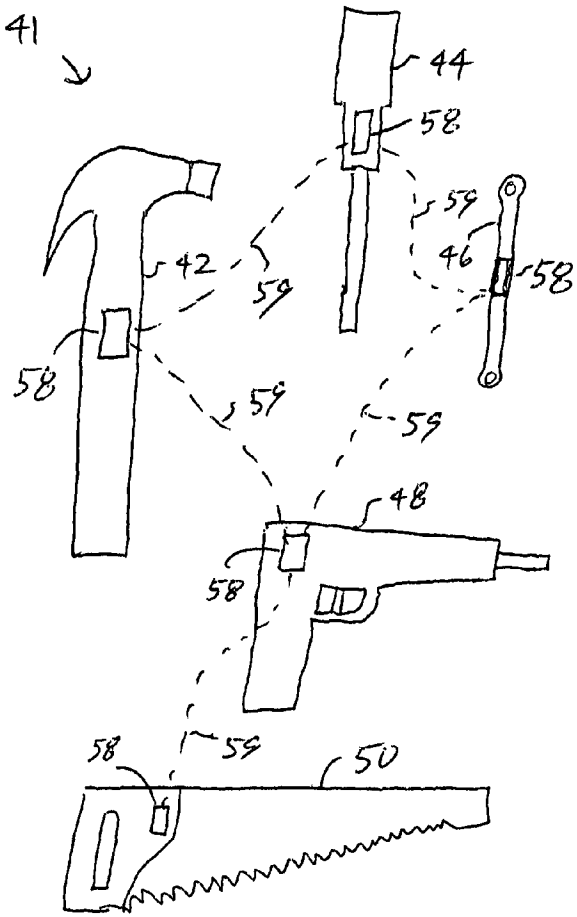
FIG. 3 is another embodiment of an exemplary set of items that are in wireless communications with one another, in accordance with one embodiment of the present invention.

Referring to FIG. 3, in another exemplary embodiment of the present invention, a set of items 41 includes five tools, namely, a hammer 42, a screwdriver 44, a wrench 46, a drill 48 and a saw 50, on each of which is mounted a respective wireless communication device 58 (e.g., corresponding to the devices 8 of FIG. 1) capable of communications with the other (or at least one or more of the other) devices by way of wireless communication links or networks 59. This embodiment likewise is intended to exemplify a variety of embodiments of the present invention in which multiple tools or pieces of equipment include wireless communication devices allowing for communications therebetween.

Figure 4:
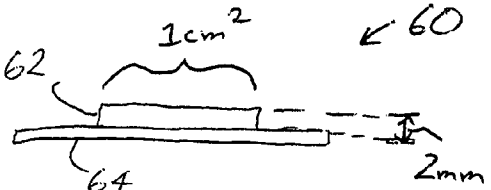
FIG. 4 is a side elevation view of an exemplary wireless device that can be, in at least some embodiments, employed in the embodiments of FIGS. 1-3.

The wireless communications devices 8, 11, 30, and 58 can take a variety of forms depending upon the embodiment. Preferably (albeit not necessarily), the devices are quite small such that the devices, while positioned typically at or near the surfaces of the various items on which they are implemented, do not occupy or cover much of the surface of the items and do not protrude out far from the surfaces of the items. Referring to FIG. 4, one such form of wireless communication devices 60 is shown to occupy about or less than a square centimeter in surface area and preferably only 2 mm or less in depth.

In some embodiments of the present invention, the wireless communication devices 8, 11, 30, and 58 are fully integrated with the items on which they are mounted, e.g., manufactured as parts of those items. However, it is also envisioned that in at least some such embodiments the devices are addable and mountable onto items such as the items 2, 4, 6, 10, 20, 42, 44, 46, 48 and 50 of FIGS. 1-3 after those items are purchased, by a purchaser or user of the items. In such cases, the wireless communication devices 8, 11, 30, and 58 can each take the form of an add-on (e.g., aftermarket and/or modular) wireless communication device 60 such as that shown particularly in FIG. 4, in which a wireless communication device 62 is mounted on/formed in combination with a mounting structure/fastening component 64 allowing for the wireless communications device to be mounted/fastened onto an item of the purchaser's/user's choosing.

The particular mounting structures/fastening components employed can vary significantly depending upon the embodiment. For example, the fastening component can be a substantially planar structure having adhesive (e.g., a tapelike structure) on one side allowing the wireless communications device to be stuck onto an item such as the hammer 42 of FIG. 3. Also, the fastening component can include Velcro or another type of fastener such as a button, a hook, a clasp, a snap, or similar feature. In some embodiments, the mounting structure would be of a form that allowed the overall structure to be sewn onto an item such as the socks 10, 20 of FIG. 2. Further, in some embodiments, the wireless communications devices can be fastened by way of welding, molding, tying or other techniques. Thus, the mounting structure/fastening component 64 shown in FIG. 4 is also intended to be representative simply of a surface of an item on which the wireless communication device is mounted.

Figure 5:
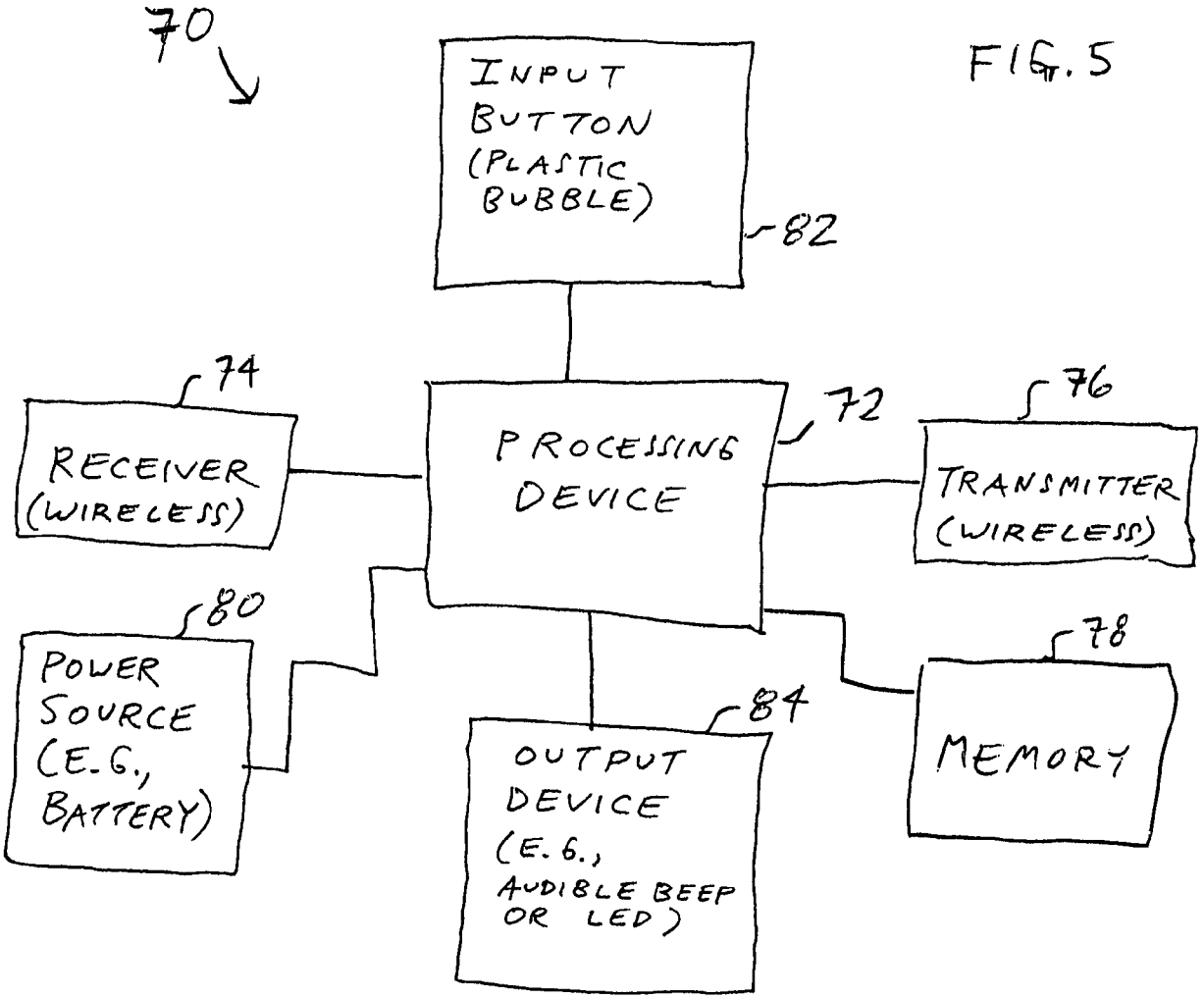
FIG. 5 is a block diagram showing exemplary internal parts of one of the wireless communications devices implemented in the embodiments of FIGS. 1-4.

Referring now to FIG. 5, the devices 8, 11, 30 and 58 employed for wireless communications can take a variety of forms depending upon the embodiment. FIG. 5 shows one set of exemplary internal components 70 that can be used in some, albeit not necessarily all, embodiments. In the embodiment of FIG. 5, the internal components 70 include a processing device (e.g., a microprocessor, programmable logic device, etc.) 72 that is coupled to each of a wireless receiver 74 and a wireless transmitter 76. In some embodiments, the receiver and transmitter are implemented as a single transceiver device.

Also, in some embodiments, the internal components would only include one of the receiver and the transmitter, such that one (or some) of the wireless communication devices were capable only of transmitting signals while others were only capable of receiving transmitted signals. Thus, only one-way rather than two-way communications would be possible among any given pair of such wireless communications devices.

The present invention is intended to encompass wireless communication devices that communicate one or more signals of a variety of formats and/or protocols and at a variety of frequencies. The devices can, for example, communicate using simple AM or FM signals, more complicated communications protocols such as those used by cellular telephones (e.g., GSM or CDMA) or BlueTooth devices, and a variety of other types of formats/protocols. The signals can be potentially communicated by way of wireless Internet protocols and/or in accordance with RFID specifications. In some embodiments, the wireless communications devices are or include one or more microstrip antennas, such as (for example) microstrip patch antennas.

In preferred embodiments, the wireless communication devices communicate by way of signals that are as simple as possible. For example, one wireless communication device can communicate with another of the wireless communication devices (and potentially with multiple other wireless communication devices) simply by transmitting a pulse signal that was capable of being recognized by the other device. In some such embodiments, the pulse signal would include a code indicating the identity of the transmitting wireless communication device. Preferably the wireless communication devices would be capable of achieving wireless communications over (at least) a likely distance by which the items of the set would likely be separated. In many cases, in which the items of a set are likely to be positioned at different locations within a given person's home or property, the devices desirably are capable of communications over about a hundred foot range (or perhaps more, for larger properties). In other embodiments, the wireless communication devices can communicate over greater or lesser distances.

Further, the processing device 72 is coupled to each of a memory 78, a power source/battery 80, one or more input devices 82 and one or more output devices 84. In some embodiments, the memory 78 can be very limited in scope or need not even be present (e.g., in such embodiments, communications can be limited to a specific signal or signals that the processor is programmed to transmit or recognize upon receipt). Indeed, in at least some simple embodiments, no processing device need be employed, or only one or a very limited number of switches or other processing components are employed. The battery is configured as appropriate. For example, for the wireless communication devices 30 implemented in the socks 10, 20, the battery preferably would be sufficient to allow for continued operation of the wireless communication device 30 within which it is implemented over the life of the sock (e.g., perhaps 2-3 years of intermittent operation).

The input and output devices 82 and 84, respectively, can take a variety of forms depending upon the embodiment. For example, the input devices 82 can merely be membrane switches, pushbutton switches or similar, robust switching or other input devices that would allow a user to provide an input signal and also would be capable of sustained operation over a desired lifetime of use. In at least some embodiments, a given wireless communication device can have multiple such input devices allowing a user to input multiple different commands, either by pressing/actuating different ones of the devices, or by providing coded commands (e.g., by pressing different switches in a particular order). In other embodiments, the input and/or output devices can take a more sophisticated form allowing for more complicated information to be entered and received (e.g., a small keypad). In some embodiments, nanotechnology is employed in one or more of the input/output devices to miniaturize one or more components of those devices.

The output device(s) 84 in some embodiments can include one simple audible sound generating device or multiple such devices. In some such embodiments, such sound generating devices are configured to produce a fairly high-pitched noise that would be reasonably capable of attracting the attention of a person nearby (e.g., a high-pitched beeping). In other embodiments, the noise can be a musical tone or tones or a voice-synthesized sound (e.g., "Here I am"). In other embodiments, the output devices 84 can be one or more small light-emitting diodes or other visual indicators, or include both sound generating and visual devices. In further embodiments, the output devices can be more sophisticated devices capable of generating more complicated or informational signals, such as a LCD display.

Preferably any such input and output devices, as well as the overall wireless communication devices of which those input and output devices formed a part, would be robust enough to maintain operation notwithstanding the particular hazards or environmental conditions typically encountered by the items of the set on which the input and output devices were mounted. For example, were the wireless communication devices to be mounted on garments such as the socks of FIG. 2, the wireless communication devices, including the input and output devices, would desirably be sufficiently robust so as to be able to survive repeated washing and drying operations performed on the socks.

Also, the wireless communication devices typically would be configured so that the devices can continue operating while the items of the set on which the devices were mounted were still in use. For example, the wireless communication devices typically would have sufficient stored energy or power that they can continue operating during the lifetime of the items with which they were associated. While it is envisioned that many of the wireless communication devices would employ a conventional battery, in at least some embodiments the devices can employ technologies allowing for the providing of energy to the devices or the recharging of the batteries on the devices. Additionally for example, in the above-described embodiment in which wireless communication devices were implemented on socks, the devices can employ a technology by which batteries on the devices can be recharged by the heat to which the socks were exposed during drying of the socks during a washing/drying operation.

Figure 6:
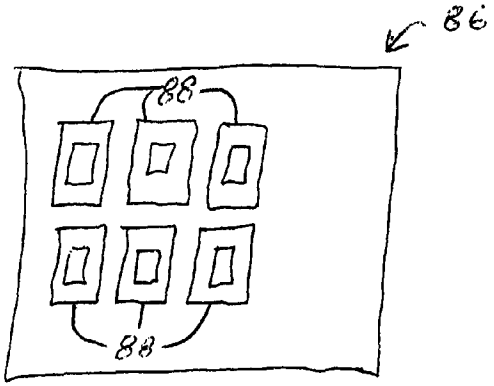
FIG. 6 shows an exemplary pack of wireless devices that can be purchased independently of a set of items on which the wireless devices are intended to be implemented.

Referring to FIG. 6, as already mentioned above, in some embodiments of the present invention it is intended that devices 8, 11, 30 and 58 be add-on devices that can be purchased separately from the items on which they are eventually implemented, which can in some cases be purchased/obtained by consumers as aftermarket components. For example, as shown in FIG. 6, a six-pack 86 of add-on wireless communication devices 88 can be made available to consumers in retail stores. Upon purchasing the six-pack 86 of the add-on devices 88, each of which can in some embodiments take the form of the device 62 shown in FIG. 2, a consumer can then mount/affix/attach two or more of the add-on devices on items of a set of items. That the pack 86 contains six of the add-on devices 88 is only intended to be exemplary; indeed, the pack can contain any number of the add-on devices, so long as it was greater than two.

Turning to FIG. 7, a flow chart 100 is provided showing an exemplary set of steps that is intended to be representative of a variety of similar operations that can be performed to facilitate the identification, location, finding, matching and/or other association of a desired member (or members) of an exemplary set of items when the items of the set include wireless communication devices, in accordance with at least one embodiment of the present invention. More specifically, the flow chart 100 illustrates how, by way of limited communications from a first wireless communication device mounted on a first item of a set (e.g., the first sock 10 of FIG. 2) to a second wireless communication device mounted on a second item of the set (e.g., the second sock 20 of FIG. 2), and the consequent providing of an appropriate output signal by the second wireless communication device, identification/location of the second item of the set is facilitated such that the first and second items can be associated with one another.

As shown, suppose upon starting at a step 90, a person has in his or her possession the first sock 10 but cannot find the second, matching sock 20 either because the sock 20 is located in another room of the person's home (or another location that is immediately in front of the person, e.g., another drawer of the person's dresser) or because the sock 20 is one of many socks in a pile of socks situated proximate the user (or even because the first sock is on one of that person's feet and the other sock is on the foot of another party, e.g., the person's brother!). Assuming this to be the case, the person at a step 92 provides an input command to the wireless communication device on the first sock 10. For example, presuming that the wireless communication device includes a membrane switch, the user merely presses the wireless communication device between his or her fingers so as to provide the input signal.

Next, at a step 94, upon the input command being received at an input device of a wireless communication device, a signal in turn would be communicated from that input device to the processing device of the wireless communication device. Further, at a step 96, the processing device can at that point then determine whether a wireless signal should be transmitted by the wireless communication device (e.g., the device 30 of the sock 10 of FIG. 2). In at least some embodiments, the processing device is configured to always cause the transmission of a wireless signal upon the receipt of the input command. In other embodiments the processing device might do so under some circumstances, and not do so under certain circumstances—for example, if the wireless communication device was determined to be running low on power, or if the input command was a particular type of input command different from other input commands, e.g., the input command was a "turn off" command provided by way of the pressing of the membrane switch two times in rapid succession, or under other circumstances.

Assuming that the processing device determines that the wireless signal should not be transmitted, then the routine ends at a step 98. However, assuming that the processing device determines that the wireless signal should be transmitted, then at a step 102 the processing device sends a signal to the transmitter (such as the transmitter 76 of FIG. 5) of the wireless communication device of the first sock causing the transmitter to output a wireless signal capable of being received by another device. In the present embodiment involving two socks of a pair of socks, this wireless signal in particular is received by the receiver (such as the receiver 74 of FIG. 5) of the wireless communication device on the second sock (e.g., the device 30 on the sock 20 of FIG. 2).

As discussed above, in at least some embodiments, the wireless signal transmitted from the first sock to the second sock can merely be a wireless signal having coded information representing the identity (or type) of the first sock. Therefore, as shown in an additional step 106, upon receiving the wireless signal, the signal (or a signal based thereupon) is provided to the processing device of the wireless communication device of the second sock and further, in a step 108, that processing device determines whether the received signal is from its matching sock. If not (e.g., the first and second socks being described are not in fact matching socks), then the routine proceeds to step 98 and nothing happens. However, if so, at a step 110 the processing device of the wireless communication device of the second sock causes an output device (such as the output device 84 of FIG. 5) to produce an output signal, which for example can be an audible output signal such as a relatively high-pitched "beep" or series of "beeps".

The occurrence of the output signal or signals at step 110 in many or most (albeit possibly not all) situations will be sufficiently noticeable to the person who originally provided the input command at the first sock that the person will be able to find/locate the second sock and thus associate the first and second socks with one another (right away, or at least when that first person, or another person with whom the first person is in communication, walks around and eventually moves to a location sufficiently close to the second sock). Thus, at this point the routine ends at step 98. However, in situations where the person is not able to locate the matching sock, the routine can be repeated by returning to the step 90. Although in the present embodiment it is envisioned that the output signal will be of relatively short duration (to conserve on power usage by the wireless communication devices), in at least some embodiments the output signal might carry on for a long duration (e.g., 5 minutes or more). If the person located the sock producing the output signal earlier than the expiration of the long duration period, the person can cause the output signal to turn off by providing an appropriate input command to the input device of the located (e.g., second) sock.

Although FIG. 7 describes one exemplary set of steps that can be implemented to allow for the associating/matching of a pair of socks such as those shown in FIG. 2, the present invention is also intended to encompass similar sets of steps that were implemented to allow for the identifying, locating, finding, matching and/or other associating of numerous other items of numerous other types of sets such as those described above. In some embodiments such as that involving the tools as shown in FIG. 3, because there are more than two members of the given set, it is envisioned that the providing of an input command to a wireless communication device associated with one of the members of the set would result in the transmission of a wireless signal that would be received by multiple other members of the set, and that each of those members of the set would in response provide a desired output signal.

Although in such embodiment it might be the case that numerous members of a set would simultaneously provide output signals, this would not typically diminish the operability of the method in allowing a person to locate a missing member of the set. More particularly, since often the missing member of a set will be located relatively far away from the other members of the set, the output signals provided by the members of the set that are not lost will not conflict with or drown out the output signal provided by the lost member of the set. For example, if the input command was provided to the wireless communication device 58 on the hammer 42 of FIG. 3, it might precipitate output signals at each of the wireless communication devices of each of the screwdriver 44, wrench 46, drill 48 and saw 50. Yet if the wrench 46 was the tool that was missing from the set and was in a different room than all of the other tools including the hammer 42, the fact that each of the screwdriver 44 and saw 50 were providing a beeping output signal would not undermine the ability of the person searching for the wrench 46 to locate the wrench in that different room as the person walked through that different room in search of the wrench.

Yet in alternate embodiments, modified versions of the steps provided in FIG. 7 (or additional steps) can be implemented so as facilitate the identifying, finding, locating, matching, or other associating of missing members of a set, particular with respect to sets having more than 2 members. For example, in one alternate embodiment, each of the wireless communication devices 58 on the tools of the set 41 can have 4 input buttons, one corresponding to each member of the set other than the member on which the respective wireless communication device was positioned. For example, the hammer 42 can have 4 input buttons respectively corresponding to the screwdriver 44, wrench 46, drill 48 and saw 50. Given such an embodiment, the user can select which of the 4 buttons to be pushed based upon which of the 4 corresponding tools was missing (e.g., if the wrench was missing, the user can press the particular button corresponding to the wrench). To facilitate such selection, each button can have a label or icon indicating the item to which it pertained.

In another alternate embodiment, a given wireless device of a given item of a given set will only have a single input button, but still a person can determine that the wireless device transmit a signal intended for receipt by a particular one of the other items of the set by providing a particular input signal via the single input button. For example, each of the tools of the set 41 of FIG. 1 can have an associated number, e.g., the hammer 42 being number "1", the screwdriver 44 being number "2", the wrench 46 being number "3", the drill 48 being number "4", and the saw 50 being number "5". A person can provide an input command to the hammer 42 causing specifically the wireless communication device of the wrench 46 to output a signal by pressing the input button on the hammer three times in rapid succession to signify the wrench's corresponding number, such that the processing unit of the wireless communication device of the hammer can recognize that the input command was specifically intended for receipt by the wrench and not the other tools.

As already indicated above, the present invention is capable of being implemented in conjunction with items of a variety of types of sets. Also, the present invention is capable of being implemented through the use of wireless communication devices that can be mounted onto sets of items of interest after the purchase of those items, e.g., the wireless communication devices can be bought as aftermarket components and then affixed to items of a set of the customer's choosing. For example, in one embodiment, a person can purchase two of these wireless communication devices and mount one on a VCR (or TV or some other household electronic device) and another on a remote controller that was used for controlling the VCR (or other electronic device). Then, if the remote controller became misplaced at some point, the person can go to the VCR, provide the input command to the wireless communication device on the VCR, so as to cause the output signal to be generated by the wireless communication device on the remote controller, which then typically would facilitate the locating of the remote controller.

An embodiment such as the above-described embodiment involving the VCR and remote controller would be advantageous notwithstanding the fact that the remote controller by itself already had a capability of providing wireless (e.g., infrared) signals to the VCR, since wireless communication in the opposite direction is not conventionally available. That is, in such an embodiment, the present inventive system and method provides an improvement over the preexisting communications available between the remote controller and the VCR since, due to the addition of the present inventive system and method, wireless communications from the VCR to the remote controller facilitating locating of the remote controller becomes possible.

Embodiments of the present invention in which items of a set are supplemented by an additional wireless communications capability are also different from conventional in-home wireless telephone systems that include a location capability. In particular, some conventional in-home wireless telephone systems include a base station and a handset that are capable of wireless communications with one another. The wireless communication system in such telephone systems is capable of allowing not only conventional telephone communication (e.g., where a person communicates via the handset, which relays signals to and from the base) but also an intercom capability and a location feature, where upon pressing a button at the base station a beeping sound is generated at the handset allowing for finding of the handset.

Yet in contrast to such conventional systems, the present inventive system and method does not depend upon the availability of a preexisting wireless communications capability. Indeed, in many if not most embodiments of the present invention, the items of the set of items on which the wireless communication devices of the present invention are implemented are not wireless communication devices and have a primary functional purpose that has nothing to do with wireless or other communications (e.g., the primary purpose of a pair of socks is to clothe a person's feet and not for wireless communications). Even in embodiments of the present invention in which the wireless communications devices of the present invention are implemented upon items of a set that themselves have some wireless communications capability (e.g., the VCR and remote controller), the items of the set lack a wireless communications capability that would allow or facilitate the location, identification or other association of one or more items of a set.

Further, in some embodiments, the present invention is intended to encompass the implementation of multiple such wireless communication devices even where one or more of the wireless communication devices are mounted not on items of a given readily-identifiable set but instead are merely mounted at another location. For example, one of the above-described wireless communication devices can be mounted in a convenient location on a wall in a person's kitchen, and others of the wireless communication devices can be mounted on items of a set of various items that are occasionally but not frequently of use in the kitchen, for example, several appliances or utensils such as a turkey cutting knife, a blender, a slow-cooker and a fruit-juice making device. Thus, even though the items of interest might usually be stored at a location (or locations) outside of the kitchen (e.g., in the basement of a home), by providing the appropriate input command to the wireless communication device on the wall in the kitchen, the person can cause an output signal to provided at the location of a desired device to facilitate the finding of that device. In a similar embodiment, a person might mount one wireless communication device on a wall of the person's home and another of the wireless communication devices on a person's keychain (or one or more of the keys on the keychain, or even some other desirable item including again, for example, a person's wallet or camera or videocamera) to facilitate finding of the keychain when it is lost.

Indeed, the present invention is intended to encompass embodiments in which there are two (or more) of the wireless communication devices, where one of the wireless communication devices is mounted or positioned on a known structure or device (or otherwise at an appropriate, convenient location) and the other of the wireless communication devices is located on a single device (or possibly multiple devices) of interest. Again for example, a person can position one of the wireless communication devices at a desk or workplace in the person's home where the person ordinarily handles financial matters such as the payment of bills, and also position one of the wireless communication devices at a checkbook from which checks are normally written (or a wallet). Then, at such times when the person desires to pay bills but for some reason the checkbook is not in its ordinary location, the person can merely provide the input command at the wireless communication device at the desk/workplace, which would result in the providing of the output signal at the checkbook, thus facilitating the use of the checkbook.

Embodiments such as the aforementioned one involving the single checkbook are considered to be within the scope of the invention, since in such embodiments the checkbook and the wall or other structure on which the two wireless communication devices are mounted can be considered to be two items of a set of related items insofar as each of the items/structures has a respective wireless communication device that is related to (e.g., capable of communication with) the other respective wireless communication devices. Thus, as mentioned before, the embodiment described above in FIG. 1 having both three of the wireless communication devices 8 and the further wireless communication device 11 can be considered, depending upon one's perspective, as involving either a set of three items (e.g., items 2, 4 and 6) or a set of four items (e.g., items 2, 4 and 6 as well as the structure with which the wireless communication device 11 is associated).

From the above-described embodiments of the present invention, it is apparent that the present invention in particular is useful for locating items of a set of inanimate items, or at least items that are not self-ambulatory (including, for example, plants). Generally speaking, the above-described embodiments do not relate to devices used to keep track of persons who are among a larger group of persons, or animals that are among a larger group of animals. Nevertheless, in alternate embodiments, the present invention can encompass embodiments in which animals (or even persons) have wireless communication devices associated with them that allow those animals to be located. Such alternate embodiments in at least some cases will require different manners of implementing the wireless communication devices on the animals (or persons) than the manners discussed above. For example, the wireless communication devices can potentially be mounted on chains hung on the animals (e.g., around their necks) or alternatively embedded under the skin of the animals.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. A system for facilitating locating of a first item of a set of items, the system comprising:

a first wireless communication device associated with the first item of the set, the first wireless communication device including an output device and a first wireless receiver;

a second wireless communication device associated with a second item of the set, the second wireless communication device including an input device and a first wireless transmitter;

wherein the second wireless communication device in response to a first input signal provided via the input device transmits a first wireless signal by way of the first wireless transmitter, wherein the first wireless communication device receives the first wireless signal and provides a first output signal in response to receiving the first wireless signal, wherein the first output signal is at least one of sufficiently visible and sufficiently audible so as to facilitate the locating of the first item of the set in a circumstance in which the first item is not yet located by a person, so that the first item can be associated with the second item, wherein the first and second items during an absence of the first and second wireless communication devices would be unable to communicate a wireless signal therebetween from the second item to the first item, and wherein the first and second items are first and second related clothing articles.

2. The system of claim 1, wherein the first and second items are complementary items or identical items.

3. The system of claim 2, wherein the first and second items are first and second shoes, respectively, or first and second boots, respectively.

4. The system of claim 2, wherein the first and second items are first and second gloves, respectively, or first and second mittens, respectively.

5. The system of claim 2, wherein the first and second items are a suit coat and related pants, respectively.

6. The system of claim 2, wherein the first and second items are respectively two items selected from the group consisting of complementary blouse, skirt, sweater, jacket, dress, and pants items.

7. The system of claim 1, wherein the first and second items are either two related towels, respectively, or two items that are each one of a bedsheet or a pillowcase.

8. The system of claim 1, wherein functional purposes of the first and second items during the absence of the first and second wireless communication devices do not include any wireless communication function.

9. The system of claim 1, wherein the input device is a user-actuatable membrane switch, and the output device is at least one of a sonic output device and a light emitting device.

10. The system of claim 1, wherein each of following is true:

the second wireless communication device includes a membrane switch that is the input device and the first wireless communication device includes a high-pitch beep generator that is the output device; and the first wireless receiver of the first wireless communication device includes a microstrip patch antenna.

11. The system of claim 1, wherein each of following is true:

the first wireless communication device includes means for attaching that is selected from the group consisting of an adhesive structure, a Velcro structure, a button, a hook, a clasp, a snap, or a fastener, a sewn link, a tied linkage, a welded portion, and a molded portion;

the first wireless communication device is designed to withstand environmental conditions to which the first item is likely to be subject; and wherein the first wireless communication device is configured to have sufficient power to last approximately an expected lifetime of the first item.

12. The system of claim 1, wherein the set of items additionally includes a third item, wherein the third item has associated with it a third wireless communication device, and wherein the third wireless communication device includes a second receiver.

13. A system for facilitating locating of a first item of a set of items, the system comprising:

a first wireless communication device associated with the first item of the set, the first wireless communication device including an output device and a first wireless receiver;

a second wireless communication device associated with a second item of the set, the second wireless communication device including an input device and a first wireless transmitter;

wherein the second wireless communication device in response to a first input signal provided via the input device transmits a first wireless signal by way of the first wireless transmitter, wherein the first wireless communication device receives the first wireless signal and provides a first output signal in response to receiving the first wireless signal, wherein the first output signal is at least one of sufficiently visible and sufficiently audible so as to facilitate the locating of the first item of the set in a circumstance in which the first item is not yet located by a person, so that the first item can be associated with the second item, wherein the first and second items during an absence of the first and second wireless communication devices would be unable to communicate a wireless signal therebetween from the second item to the first item, and wherein the first and second items are one of: first and second tools of a set of tools; first and second pieces of dishware or glassware of a set of dishware and/or glassware; first and second utensils; or first and second books or other reading materials.

14. The system of claim 13, wherein each of following is true:

the second wireless communication device includes a membrane switch that is the input device and the first wireless communication device includes a high-pitch beep generator that is the output device; and the first wireless receiver of the first wireless communication device includes a microstrip patch antenna.

15. The system of claim 13, wherein each of following is true:

the first wireless communication device includes means for attaching that is selected from the group consisting of an adhesive structure, a Velcro structure, a button, a hook, a clasp, a snap, or a fastener, a sewn link, a tied linkage, a welded portion, and a molded portion;

the first wireless communication device is designed to withstand environmental conditions to which the first item is likely to be subject; and wherein the first wireless communication device is configured to have sufficient power to last approximately an expected lifetime of the first item.

16. The system of claim 13, wherein the set of items additionally includes a third item, wherein the third item has associated with it a third wireless communication device, and wherein the third wireless communication device includes a second receiver.

17. The system of claim 13, wherein the wherein the first and second items are either:

the first and second pieces of dishware or glassware; or the first and second books or other reading materials.

18. A method of locating a first item of a set of items, the method comprising:

providing an input command to a first wireless communication device associated with a second item of the set in a circumstance in which the first item is not yet located by a person, so that the first item can be associated with the second item;

transmitting a first wireless signal from the first wireless communication device to a second wireless communication device associated with the first item of the set;

outputting at least one of an audible signal and a visible signal from the second wireless communication device, wherein the first and second items during an absence of the first and second wireless communication devices would be unable to communicate a wireless signal therebetween from the second item to the first item, and wherein the first and second items are first and second related clothing articles, whereby the person searching for the first item is able to sense the audible or visible signal and thereby locate the first item of the set.

19. The method of claim 18, wherein the first and second items are complementary items or identical items, and wherein the first and second items are first and second shoes, respectively, or first and second boots, respectively, or first and second gloves, respectively, or first and second mittens, respectively.

20. The method of claim 18, further comprising:

attaching the first wireless communication device to the second item by way of first means for attaching, and attaching the second wireless communication device to the first item by way of second means for attaching.

* * * * *